United States Patent [19]

Pamlin et al.

[11] Patent Number: 4,758,136

[45] Date of Patent: Jul. 19, 1988

[54] SCREW COMPRESSOR LUBRICATION CHANNEL FOR LUBRICATION OF A ROTOR BEARING

[75] Inventors: Roland Pamlin, Handen; Lars Sjöholm, Sollentuna, both of Sweden

[73] Assignee: Svenska Rotor Maskiner AB, Stockholm, Sweden

[21] Appl. No.: 934,444

[22] PCT Filed: Mar. 21, 1986

[86] PCT No.: PCT/SE86/00125

§ 371 Date: Nov. 12, 1986

§ 102(e) Date: Nov. 12, 1986

[87] PCT Pub. No.: WO86/05556

PCT Pub. Date: Sep. 25, 1986

[30] Foreign Application Priority Data

Mar. 22, 1985 [SE] Sweden ..... 8501440

[51] Int. Cl.[4] ..... F04C 29/02; F04C 18/16

[52] U.S. Cl. ..... 418/15; 418/98; 418/100; 418/201

[58] Field of Search ..... 418/15, 100, 102, 201, 418/98

[56] References Cited

U.S. PATENT DOCUMENTS

| | | | |
|---|---|---|---|
| 3,899,271 | 8/1975 | Glanvall | 418/100 |
| 4,394,113 | 7/1983 | Bammert | 418/98 |
| 4,439,121 | 3/1984 | Shaw | 418/201 |

*Primary Examiner*—John J. Vrablik
*Assistant Examiner*—Leonard P. Walnoha
*Attorney, Agent, or Firm*—Frishauf, Holtz, Goodman & Woodward

[57] ABSTRACT

A screw compressor lubrication channel for lubrication of a rotor bearing on the compressor's low pressure side, which is supplied with refrigerant droplets containing oil accompanying the inlet gas. This kind of lubrication is usually carried out by permitting a limited amount of gas and oil to flow from the high pressure side to the low pressure side via the bearings located on the low pressure side, and further to the inlet. By this working mode compressor capacity as well as compression work deposited is lost. This is avoided when the compressor according to the present invention is provided with a special, smaller inlet channel (7), which via the rotor bearing (3) opens out in a specific inlet port (8) located at an expanding rotor thread presenting a lower pressure than the inlet (6) pressure of the compressor.

4 Claims, 1 Drawing Sheet

SCREW COMPRESSOR LUBRICATION CHANNEL FOR LUBRICATION OF A ROTOR BEARING

BACKGROUND OF THE INVENTION

This invention relates to a screw compressor means for lubrication of a rotor bearing on the compressor's low pressure side, which is supplied with a refrigerant containing oil for lubrication of the compressor's working chamber.

In a refrigeration compressor which is run with circulating oil, the rotors are lubricated with help of the oil-enriched refrigerant droplets which accompany the inflowing gas. After completed compression, a certain amount of the gas and oil is allowed to escape along the high pressure side's rotor axis, through the bearings and finally arrive at a closed thread with lower pressure than that present at the corresponding bearing.

There is no such usable pressure difference for the low pressure bearings. Gas and oil are therefore usually allowed to pass through a longitudinal boring through the rotor axis from the high pressure side to the low pressure side, through the low pressure rotor bearings and to the inlet. By this both compressor capacity and compression work from the returning gas stream is lost. Furthermore, a certain amount of heating of the bearing occurs.

The object of this invention is to achieve an improved lubrication of the bearings on the low pressure side. This has, according to the invention, been achieved by means of the features specified by the following patent claims.

Normally, an expanding thread is placed in the compressor in immediate connection to the compressor's inlet. By separating, in accordance with the invention, the inlet port into two ports, the possibility of two suction levels is achieved simply. The thread's first suction takes place, therefore, through the specifically arranged port, by which a lower pressure level is obtained than the pressure level that occurs at the compressor's inlet. A flow of gas and oil through the bearings on the low pressure side can thereby be achieved. This flow cools the bearings by its low temperature and lubricates the bearings by means of accompanying oil-enriched refrigerant droplets.

DETAILED DESCRIPTION

Figure 1:
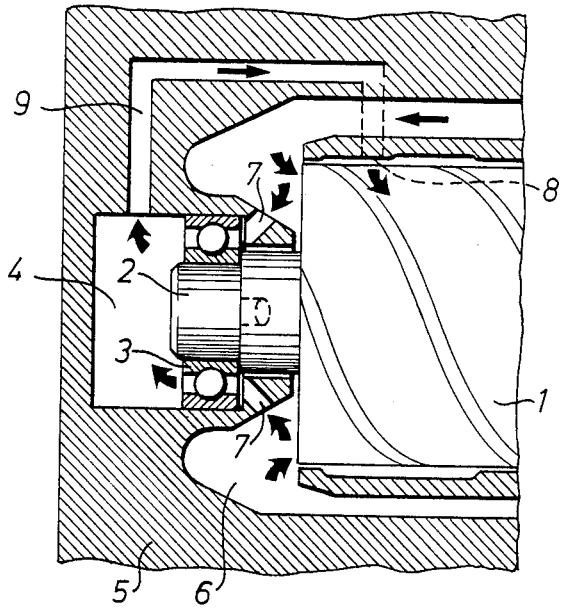
FIG. 1 schematically illustrates, as an example, a longitudinal section of an embodiment of a screw compressor lubrication means in accordance with the invention.

FIG. 1 shows the low pressure end of a rotor 1 in a screw compressor. This end of the rotor has a shaft 2 which, by means of a bearing 3 is journalled in a chamber 4 in the end wall 5 of the compressor housing.

The compressor's inlet channel is denoted 6 and communicates with the chamber 4 via short passages 7 which open out at the inner end wall of the bearing 3. Between the chamber 4 and a specific inlet port 8 in the compressor housing there is a channel 9. The port 8 is so designed that, during the first expansion of the thread, a lower pressure is produced here rather than at the compressor's ordinary inlet. This lower pressure is transmitted through the channel 9 to the chamber 4, by which refrigerant and oil will be moved by suction from the inlet 6 via the channels 7, the bearing 3, the channel 9 to the port 8. Preferably, the refrigerant is conducted in liquid form to the channels 7 from a point on the low pressure side, i.e. after an expansion valve in the cooling circuit where enrichment of refrigerant liquid and oil can take place. Also a buffer chamber forming a part of the inlet channel is advisable.

Figure 2:
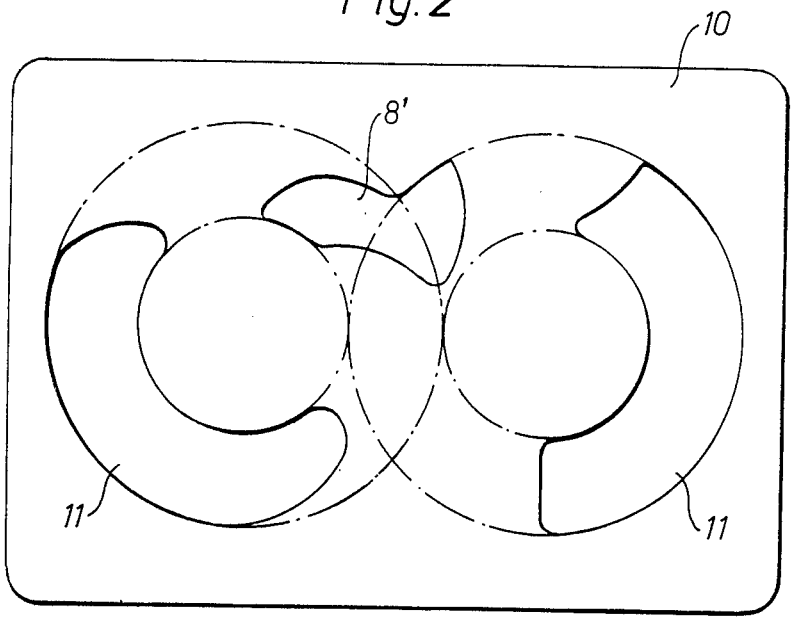
FIG. 2 schematically shows a specific axial inlet port.

Moreover or as an alternative the specific inlet port may be designed as an axial port 8′ in the low pressure end wall 10, as shown in FIG. 2, the usual axial inlet port 11 being divided into two parts on opposite sides of the specific port 8′, which should be connected to the channel 9 in FIG. 1 (not shown).

We claim:

1. In a screw compressor, means for lubrication of a rotor bearing (3) on the compressor's low pressure side, which is supplied with a refrigerant containing oil for lubrication of the compressor's working chamber, the screw compressor having an inlet channel (6) and a main inlet port (11), the improvement wherein:

the screw compressor is provided with a special, additional smaller inlet channel (7, 9) which is smaller than said first—mentioned inlet channel (6), which smaller inlet channel (7, 9) passes axially through said rotor bearings (3) from one end to the other, and opens out in a specific inlet port (8, 8′) located at an expanding rotor thread with lower pressure than the compressor's inlet pressure.

2. The screw compressor according to claim 1, wherein said bearing (3) has opposite ends, and wherein one end of said bearing (3) is connected to said inlet channel (6) close to said main inlet port (11).

3. The screw compressor according to claim 1, wherein said special, smaller inlet channel (7, 9) passes oil mixed with refrigerant in liquid form through said bearing (3).

4. The screw compressor according to claim 2, wherein said special, smaller inlet channel (7, 9) passes oil mixed with refrigerant in liquid form through said bearing (3).

* * * * *